United States Patent [19]

Mayer et al.

[11] Patent Number: 4,853,690

[45] Date of Patent: Aug. 1, 1989

[54] SECURITY ALARM PROCESS AND APPARATUS

[75] Inventors: Hans-Dieter Mayer, Baltmannsweiler; Klaus Hirrlinger, Esslingen, both of Fed. Rep. of Germany

[73] Assignee: Richard Hirschmann Radiotechnisches Werk, Fed. Rep. of Germany

[21] Appl. No.: 32,615

[22] Filed: Apr. 1, 1987

[30] Foreign Application Priority Data

Apr. 3, 1986 [DE] Fed. Rep. of Germany ..... 3611184

[51] Int. Cl.[4] ..... G08B 13/20; G08B 21/00

[52] U.S. Cl. ..... 340/544; 340/611; 340/626

[58] Field of Search ..... 340/544, 626, 611, 587

[56] References Cited

U.S. PATENT DOCUMENTS

| | | | |
|---|---|---|---|
| 3,289,192 | 11/1966 | Davey | 340/544 |
| 3,898,640 | 8/1975 | Hossbach . | |
| 3,914,755 | 10/1975 | Hook | 340/544 |
| 3,947,838 | 3/1976 | La Forge, Jr. | 340/544 |
| 3,990,063 | 11/1976 | Schuman | 340/544 |
| 4,386,342 | 5/1983 | McKinley | 340/544 |
| 4,692,743 | 9/1987 | Holden et al. | 340/544 |

FOREIGN PATENT DOCUMENTS

| | | |
|---|---|---|
| 0039142 | 3/1981 | European Pat. Off. . |
| 1916472 | 3/1969 | Fed. Rep. of Germany . |
| 2237613 | 7/1972 | Fed. Rep. of Germany . |
| 2714942 | 4/1977 | Fed. Rep. of Germany . |
| 2729710 | 7/1977 | Fed. Rep. of Germany . |
| 3412914 | 4/1984 | Fed. Rep. of Germany . |

*Primary Examiner*—Joseph A. Orsino
*Assistant Examiner*—Anh H. Tran
*Attorney, Agent, or Firm*—Robert J. Koch

[57] ABSTRACT

Monitoring a room is accomplished by measurement of air pressure where air passage resistance between a secured room and an outside atmosphere is measured and an alarm actuated, if the air passage resistance drops below a predetermined value. Evaluation of typical air pressure fluctuations in a frequency range between 0.01 Hz and 10 Hz is advantageous. The air pressure resistance may be determined by difference measurements of air pressure fluctuations in the outside atmosphere and the secured room, or as a singular process wherein a connecting tube is provided between the room to be secured and the outside atmosphere, where air movements varying as a function of air pressure fluctuations are measured. Devices for the carrying out of the process are described. The devices and the process provide a simple and cost effective alarm system that operates reliably and is secure against outwitting and sabotage.

24 Claims, 1 Drawing Sheet

FIG. 1
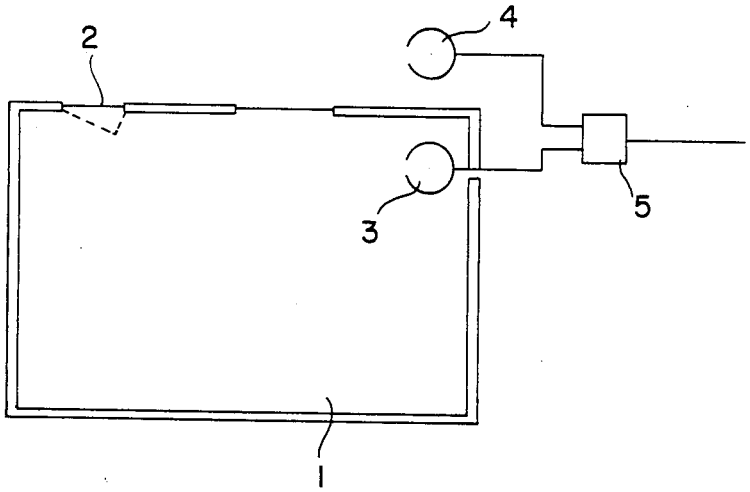
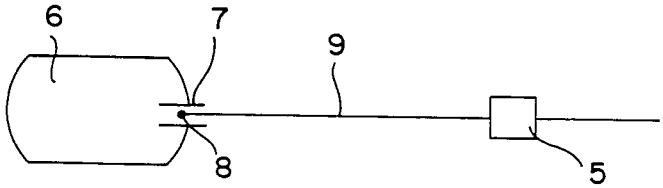
FIG. 2
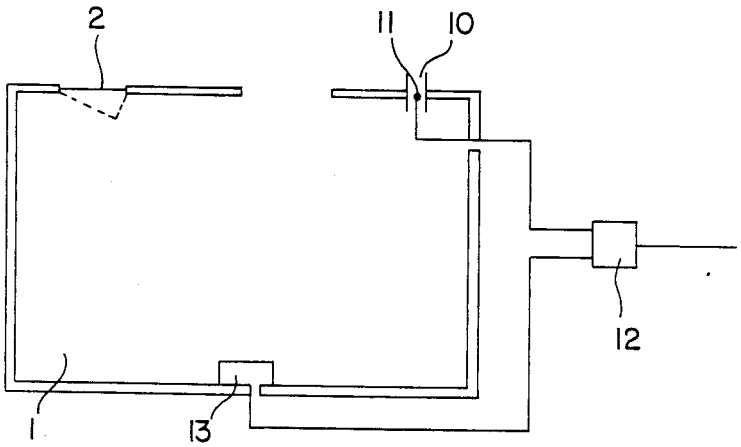
FIG. 3

SECURITY ALARM PROCESS AND APPARATUS

BACKGROUND OF THE INVENTION

1. Field of the Invention

The invention concerns a method and a device for securing an area monitoring air pressure.

2. Description of the Technology

DE-OS No. 27 14 942 and No. 27 29 710 and EP-OS No. 39 142 show alarm systems where an overpressure or a reduced pressure is generated and maintained in the monitored space or door cavity. Upon opening or a violation of a door or a window, pressure drops or rises of the space or cavity was overpressured or under a reduced pressure respectively. This change in pressure is used to actuate an alarm. Alarm systems of this type are expensive particularly in view of the energy required to maintain the overpressure or reduced pressure. In addition, the system is inactive in case of a power failure. A system of this type is susceptible to external effects, such as gusts of wind or strong external air movements, so that malfunctions may occur.

The electric alarm circuit shown in DE-OS No. 19 16 472, detects air movements generated by the movements of an intruder by a bolometer amplifier circuit and utilizes this air movement to actuate an alarm. The alarm is not actuated by measurement of air pressures or pressure differences, but merely by air movements which may be caused by the opening or violation of doors or windows and by strong wind pressures or air circulations generated by thermal effects. The actuation of the alarm is therefore not defined sufficiently or specifically enough.

In the space alarm system according to DE-OS No. 22 37 613, a sound field is generated in the room to be monitored. The sound field may be set up by a speaker, preferably in a frequency range below the audible limit of 15 Hz. The sound field measured by a microphone type pressure transducer. The alarm is actuated by phase, frequency or amplitude changes caused by intruders moving about in the room or the opening or closing of doors or windows. This system may be mislead by slow opening or closing of doors or windows. It is also susceptible to false alarms caused by changes due to external effects, such as strong gusts of wind particularly in drafty rooms and by movements of air.

A burglar alarm system is shown in DE-OS No. 34 12 914 where the air pressure is measured inside the secured room. Low frequency changes, in particular in the range of 0.01 to 1 Hz, are filtered from the frequency spectrum. The alarm is actuated upon detection of such low frequency changes. While the practical testing of this system showed that, fundamentally, it has good sensitivity, its susceptibility to interference by environmental and external effects, such as thin walls, other air movements and, for example, air pressure changes in this frequency caused by passing trucks or aircraft flying overhead was large enough to render the safe actuating of the alarm free of interference impossible. Furthermore, the system is easily defeated by slow opening and closing of windows and doors.

SUMMARY OF THE INVENTION

It is an object of the present invention to provide a security system where reliable actuation of an alarm is effected if the secured area is violated in a manner that is safe from outwitting or sabotage. The system is operated with a low consumption of energy, so that an emergency power system may be used in case of a power failure, thereby maintaining security during a power failure.

The objects according to the invention are achieved by measuring the resistance to the passage of air between the secured area and the outer atmosphere and actuating an alarm if said air passage resistance drops below a predetermined value.

A natural exchange of air always takes place between an enclosed space such as the inside of a building or contained area and the outer atmosphere or an outer room. The exchange differs as a function of tightness. In other words, the walls of the room or building exhibit a resistance to the passing of air that increases with the degree of sealing of the room or building against the outside. This air passage resistance is essentially constant for a given room or building and changes appreciably only if doors or windows are opened or an opening is created by other means, for example, a breach in the wall or the breaking of a window.

According to the invention, this change in the air passage resistance is measured and an alarm is actuated upon a significant change, i.e., the opening of a door or a window.

The particular advantage of the system according to the invention resides in that the alarm is not actuated by environmental effects, such as strong gusts of wind, wind pressure on the building, other changes in air pressure or air movements in the external atmosphere, caused, for example, by passing vehicles or aircraft flying overhead. Air pressure fluctuations occurring in the outer atmosphere, for example, on the outer skin of a building, also appear in a closed room correspondingly, but with a reduced amplitude and a certain phase shift. Both the amplitude attenuation and the phase shift are determined significantly by the air pressure resistance. In the prior systems, pressure changes and/or air movements were measured inside and utilized to actuate the alarm. External effects, such as gusts of wind or other turbulences in the outer space lead to false alarms. The false alarms do not occur in the system according to the invention because the resistance to the passage of air, i.e., the value which varies directly in case of a violation, is measured directly. External effects, such as gusts of wind and turbulences in the outer atmosphere, therefore cannot lead the actuation of the alarm. The alarm is actuated only upon creation of an additional opening in the building, for example, by opening a door or window. The actuation of the alarm is entirely independent of the velocity of the creation of an opening in the building, i.e., how rapidly or slowly the door or window is opened. Only the "bypass" created by opening a window or door in addition to the existing (or nonexisting) leaks is detected as a change in the air passage resistance.

According to a preferred form of embodiment of the invention, the resistance to the passage of air is measured for air pressure fluctuations in a frequency range of 0.01 Hz to 10 Hz, preferably 0.1 Hz to 5 Hz. Investigations have shown air pressure fluctuations take place in the aforementioned frequency ranges even in case of an apparently absolute stillness of wind and air and it has been possible always to measure only a few seconds during which no air pressure fluctuation occurs. The availability of this measuring method is therefore higher than $1:10^6$ or 99.9999%. The system according to the invention is therefore well suited to use in combination with alarm installations, as the possible short term nonfunctioning of the system of the order of magnitude of a few seconds can hardly be detected by other means. In particular, the possible short term absence of air pressure fluctuations cannot be predicted and thus utilized in any way. Obviously therefore, the process of the invention is very safe and not susceptible to outwitting and sabotage.

Air pressure fluctuations within the aforementioned frequency ranges are below the range audible sound waves and do not regularly appear. In all probability, they are generated in the free atmosphere by air turbulences on the ground surface, which occur in an undetectable range and are practically always present. The rates of the variation of air pressure fluctuations may be described by individual segments of frequency curves; the frequencies in the range are between 0.01 and 10 Hz, and in particular 0.1 to 5 Hz.

According to embodiment of the invention, the air passage resistance is determined by measuring the air pressure both in the space to be secured and in the outer atmosphere, comparing the two values measured and actuating an alarm if the amplitude and/or phase differences of the two measured values drop below a predetermined value.

As mentioned above, air pressure fluctuations in the outer atmosphere may occur and be measured inside with a reduced amplitude and a phase shift. By measuring the amplitude and/or phase difference of the air pressure fluctuations between the outside and inside spaces, the variation of the air passage resistance is determined, thereby creating an alarm criterion. The amplitude and/or phase difference becomes appreciably smaller if a "bypass" is created by opening a door or window. It is entirely immaterial whether the change in the air passage resistance, i.e., the opening of the window or door takes place rapidly or slowly.

According to a further embodiment of the invention the air pressure is measured by the air movements caused by the air pressure fluctuations. This has the advantage that it is only necessary to measure air pressure fluctuations rather than absolute pressure. The air pressure variations superposed on a base pressure are slight relative to the base pressure. The evaluation of a difference signal from the measured values of absolutely measuring pressure meters is therefore rather involved. The method according to the invention can thus be further improved and simplified. Safety and sensitivity may be enhanced by measuring air movement and therefore air pressure fluctuations only and not absolute values.

Preferably, a bolometer is used to measure air movements and thus air pressure fluctuations. The bolometer may be located in a small orifice of a rigid hollow body having a volume of at least 500 $cm^3$.

According to a further embodiment of the invention, the bolometer is heated to an excess temperature. The bolometer is inserted into the small orifice or thin connecting tube, which may be in the form of a Venturi tube, so that in case of an exchange of air between the hollow body and the outer air, a flow of air passes by the bolometer, thereby cooling the bolometer. Due to the small heat capacity of semiconductor bolometers, the cooling or the change in resistance may be directly utilized as a measure of the velocity of the air passing by. In the course of investigations, it was discovered that the exchange of air through the orifice of the hollow body and thus the velocity of the flowing air accurately follows the air pressure fluctuations in the outer space. This embodiment leads to an extraordinarily safe and sensitive system for securing a room, even if only very low air pressure fluctuations occur. It is possible by using a bolometer to measure the air passage resistance in the above-described manner on the basis of amplitude and/or phase differences.

According to an advantageous embodiment of the invention, the air pressure resistance is measured by the air movements caused by air pressure fluctuations in a connecting tube between the secured room and the outer atmosphere. This allows further simplification of the system. Air movements are preferably measured in the connecting tube between the secured room and the outside atmosphere by a bolometer. The secured room or building and its air volume act in the manner of the aforedescribed rigid hollow body. The process then requires a single bolometer measuring tube only. Air pressure fluctuations generate varying air movements in the connecting tube, which are measured by the bolometer and evaluated for the actuation of the alarm. In the alarm case, i.e., if a window or a door is opened, thereby reducing the air passage resistance in the bolometer measuring tube, so that the output signal of the bolometer drops below a predetermined value, thereby actuating the alarm. Gusts of wind or wind pressure on the building cannot trigger false alarms, as only variations of air passage resistance, i.e., relative values, and not absolute measured pressure values, as in the conventional methods, are used to actuate the alarm. The system therefore cannot be outwitted even by a slow opening or closing of doors.

This embodiment, where air passage resistance is measured by the air movements caused by air pressure fluctuations in a connecting tube between the room to be secured and the outside atmosphere, may be modified according to a further embodiment of the invention by generation of air pressure pulses in the secured room. These air pressure pulses should preferably be within a frequency range of 0.01 to 10 Hz. They may be coded or randomly generated. While the aforedescribed embodiments according to the invention were based on outside atmosphere air pressure fluctuations larger than the inner space fluctuations, this embodiment reverses the magnitude as the larger amplitudes of air pressure fluctuations occur in the secured room and not in the outer atmosphere due to the artificially generated air pressure pulses or fluctuations in the secured room. The principle of the invention remains the same, since the air movements taking place in the connecting tube correspond to the air pressure fluctuations which now take place with higher amplitudes inside. These movements are detected by the bolometer and filtered out. In case of a break-in, the amplitudes of the bolometer output signal decrease due to the reduced air movement through the connecting tube, whereby an alarm criterion is again created.

The measured air movement may preferably be related to the air pressure pulses generated. This signifies that a comparison is effected relative to the amplitudes, phases and/or frequencies between the air movements measured and the air pressure pulses generated, in the manner of a reference system. This further increases the security of an alarm and reduces the possibility of outwitting the system which is already nearly nonexistent. Even upon a very short absence of air pressure fluctuations in the outside atmosphere, the alarm process operates safely even, for example, in buildings in deeply cut valleys, where a lack of air pressure fluctuations could potentially occur more frequently. Emergency power systems are adequate to maintain operation as the consumption of energy for the generation of air pressure pulses in the monitored space is very low. A further embodiment of the invention includes means for generating air pressure pulses in the secured room only if the natural air pressure fluctuations in the outside atmosphere drop below a certain value.

According to a further embodiment of the invention, a sabotage alarm may be triggered if the air passage resistance exceeds a certain predetermined value. A case of sabotage is conceivable if an air pressure measuring instrument is destroyed or inactivated inside or outside, or if the connecting tube between the inner and the outer space is clogged. The air passage resistance could then conceivably remain above a predetermined value and no alarm would be actuated, although a door or a window may be opened. This possible sabotage method is excluded by the measure according to the invention, whereby an upper threshold value is set for the air passage resistance and whereby a sabotage alarm is triggered if said threshold value is exceeded.

Both the upper and the lower threshold value may be adapted to the conditions of individual cases, such as for example, the degree of tightness of the building.

It is further possible to expand or integrate the system into a larger alarm and security system for an entire building complex, possible with central monitoring. The very simple functioning mode and the low installation and maintenance requirements create a very broad field of application for the invention compared to conventional systems, such as glass breakage detectors or the like. The process according to the invention is also suitable for small internal spaces, such as for example, motor vehicles, mobile homes, boats and the like.

The object of the invention may be attained by a system where a pressure measuring instrument is arranged both in the secured room and in the outside atmosphere. The measured values are passed to an evaluating circuit layout comprising a stage determining the amplitude and/or phase differences of the measured values, and a threshold value stage. The evaluating circuit triggers an alarm if the amplitude and/or phase difference drops below a given value.

A further embodiment of the apparatus of the invention may include a connecting tube provided between the secured room and the outside atmosphere. The measured values in the connecting tube are passed to an evaluating circuit, which emits or actuates an alarm signal if the amplitude of the measured value signal drops below a given value.

In an embodiment incorporating an air pulse generator, the instrument for air movement measurements may advantageously be located in the connecting tube. The measured signal is preferably related with respect to amplitude and/or phase to the air pressure pulses generated.

To secure the installation against sabotage a threshold value stage may be incorporated in the evaluating circuit. The threshold value stage emits a sabotage signal if the output signal of the pressure measuring instrument exceeds an upper limiting value.

BRIEF DESCRIPTION OF THE DRAWINGS

FIG. 1 shows a schematic view of the apparatus with two pressure measuring instruments.

FIG. 2 shows an embodiment of a pressure measuring instrument as used in FIG. 1.

FIG. 3 shows an embodiment with a connecting tube between the outer atmosphere and the secured room.

DETAILED DESCRIPTION OF THE PREFERRED EMBODIMENT

FIG. 1 shows room 1 with an openable window 2 to be opened. A pressure measuring instrument 3 is located in room 1 and a second pressure measuring instrument 4 is located outside of room 1. The two measuring instruments 3 and 4 are connected to an evaluating circuit 5, the output signal of which represents the alarm signal.

In the non-alarm case, i.e., if the window 2 is closed, resistance to the passage of air exists between the outer atmosphere and the inner room 1 through the external skin of the room 1 whereby the pressure fluctuations appearing in the outside atmosphere and measured by means of the pressure measuring instrument 4 in the outside space, occur in the inner room with an attenuated amplitude and a phase shift. The internal pressure is measured by the pressure measuring instrument 3. The output signals of the two pressure measuring instruments 3 and 4 are compared in the evaluating circuit 5. In the non-alarm case, i.e., with the window 2 closed, there is an amplitude and phase difference due to the air passage resistance. If the window 2 is opened without authorization, a pressure bypass is established thereby reducing the air passage resistance or characteristic damping of the structure. This means that the air pressure fluctuations appearing outside the room 1 arrive in the room and 1 and thus at the air pressure meter 3 with a lower amplitude attenuation and a lesser phase shift than if the window 2 were closed. The amplitude and/or phase difference determined by the evaluating circuit 5 is smaller and drops below a predetermined threshold value. This is utilized as the criterion for actuation of the alarm or emission of an alarm signal.

The pressure measuring instruments 3 and 4 are preferably located in the vicinity of the doors and windows to be secured, as the amplitude attenuation and the phase shift depends to a certain extent on the position of the pressure measuring instruments. The distance between the two transducers should preferably be small, relative to the velocity of the propagation of sound in order to maintain the dependence of the amplitude attenuation and the phase shift on the distance of the two trandsducers within certain limits.

To measure the air pressure fluctuations, it is advantageous to use the bolometer layout schematically shown in FIG. 2. A rigid hollow body 6 may be utilized with a volume of at least 500 $cm^3$. A small orifice or measuring tube 7 is located in the rigid body enabling an exchange of air between the inner space of the hollow body and the outer space becomes possible. A bolometer is arranged in the orifice or measuring tube 7 as the sensor 8. The bolometer may advantageously be a semiconductor bolometer with a very low heat capacity. It is electrically heated to a certain constant excess temperature. The output signal of the bolometer is transmitted through a line 9 to the evaluating circuit 5, which corresponds to the evaluating circuit of FIG. 1.

In the case of even very small air pressure fluctuations, air flows from the outside through the measuring tube 7 into the inner space of the hollow body 6 or, inversely, from the inside through the measuring tube 7 to the outside, while passing over the semiconductor bolometer. This results in cooling and thus a change in resistance of the bolometer, which is a direct measure of the velocity of the air flowing by the meter and thus of the pressure fluctuations. The output signals of the bolometer are processed in the evaluating circuit 5.

FIG. 3 shows a further embodiment of the invention. A measuring tube 10 is located in a partition wall between the room 1 to be secured and the outside atmosphere. The measuring tube 10 forms a connection between the outside atmosphere and the secured room 1. The output signals of bolometer 11 located in the measuring tube 10 are passed to an evaluating circuit 12. The evaluating circuit may be connected to an air pulse generator 13, which is located in the room 1 and which emits air pressure pulses into the inner space. The air pressure pulses may be coded or randomly generated. If the window 2 is closed, air passes through the measuring tube 10 as a function of the air pressure pulses produced by the air pressure generator 13. The air movement in the measuring tube 12 is detected by the bolometer 11 and conducted to the evaluating circuit 12, which simultaneously also controls the air pulse generator and compares the bolometer signal with the control signal for the air pulse generator.

With the window 2 closed, i.e., in the non-alarm state, a relatively large volume of air flows back and forth at a relatively high velocity as the result of the air pressure pulses produced by the air pulse generator 13 through the measuring tube 10. If the window 2 is opened thereby invoking the alarm case, the air passage resistance of the outer skin of the building is reduced considerably, whereby the velocity of the air flowing through the measuring tube is also reduced. As the output signal of the bolometer 11 is related to the control signal of the air pulse generator 13 in the circuit 12, the open window is sensed and an alarm signal triggered. In view of the air pulse generator provided in the room 1 to be secured, the alarm system is independent from the air pressure fluctuations in the outer atmosphere, as said fluctuations are produced artificially.

The invention has been made apparent by means of certain examples. Numerous modifications and embodiments are possible for those skilled in the art without exceeding the concept of the invention. For example, any type of pressure measuring instrument or device to move the air may be used, provided that they satisfy the requirements of the invention. It is further possible for those skilled in the art to design the evaluating circuit 5 and 12 in a suitable manner for the evaluation of the signals arriving from the pressure measuring instruments or the bolometer. It is further possible to set threshold values making it possible to detect the removal of the pressure measuring instrument 4 in the outside atmosphere or when the measuring tube 10 is clogged.

We claim:

1. A method of securing an enclosed area comprising the steps of:

monitoring air passage resistance of an enclosed area; and actuating an alarm when air passage resistance falls below a predetermined level;

wherein the step of monitoring includes the steps of measuring air pressure in said enclosed area, measuring air pressure outside of said enclosed area, and evaluating the difference between air pressure in the enclosed area and air pressure outside the enclosed area.

2. A method according to claim 1 further comprising the step of:

actuating an alarm when air passage resistance rises above a second predetermined level.

3. A method according to claim 1 wherein the step of monitoring comprises monitoring air pressure fluctuations between 0.01 Hz and 10 Hz.

4. A method according to claim 3 wherein the step of monitoring comprises monitoring air pressure fluctuations between 0.1 Hz and 5 Hz.

5. A method according to claim 1 wherein the step of evaluating comprises evaluating an amplitude difference between measured air pressures.

6. A method according to claim 1 wherein the step of evaluating comprises evaluating a phase difference between measured air pressures.

7. A method according to claim 1 wherein the steps of measuring comprise measuring air pressure by evaluating air movements caused by air pressure fluctuations.

8. A method according to claim 7 wherein the steps of measuring comprise the steps of:

heating a bolometer arranged in a orifice of a rigid hollow body; and evaluating temperature changes characteristic of pressure changes.

9. A method of securing an enclosed area comprising the steps of:

monitoring air passage resistance of an enclosed area by measuring air movements through a connecting tube arranged in a wall of said enclosed area, between said enclosed area and outside said enclosed area;

actuating an alarm when air passage resistance falls below a predetermined level;

generating air pressure pulses inside said enclosed area; and evaluating measured air movements through said connecting tube in relation to generation of said air pressure pulses.

10. A method according to claim 9 wherein the step of monitoring comprises the steps of:

heating a bolometer arranged in said connecting tube; and evaluating temperature changes characteristic of pressure changes.

11. A device for securing an enclosed area comprising:

means for monitoring air passage resistance of an enclosed area; and means for actuating an alarm when air passage resistance falls below a predetermined level responsive to said means for monitoring wherein said means for monitoring includes a first means for measuring air pressure in said enclosed area, a second means for measuring air pressure outside of said enclosed area, and a means for evaluating a difference in air pressure responsive to said first and second means for measuring.

12. A device according to claim 11 further comprising:

means for actuating an alarm when air passage resistance rises above a second predetermined level responsive to said means for monitoring.

13. A device according to claim 11 wherein said means for monitoring comprises means for monitoring air pressure fluctuations between 0.01 Hz and 10 Hz.

14. A device according to claim 13 wherein said means for monitoring comprises means for monitoring air pressure fluctuations between 0.1 Hz and 5 Hz.

15. A device according to claim 11 wherein said means for evaluating comprises means for evaluating an amplitude difference between measured air pressures.

16. A device according to claim 11 wherein said means for evaluating comprises means for evaluating a phase difference between measured air pressures.

17. A device according to claim 11 wherein said means for measuring comprise means for measuring air movements.

18. A device according to claim 17 wherein said means for measuring comprises:

a rigid hollow body exhibiting a small orifice; and a bolometer arranged in said rigid hollow body.

19. A device according to claim 18 wherein said hollow body has a volume of at least 500 $cm^3$.

20. A device according to claim 18 wherein the means for measuring further comprises:

means for heating said bolometer; and means for evaluating temperature changes characteristic of pressure changes.

21. A device for securing an enclosed area comprising:

a connecting tube arranged in a wall of said enclosed area;

means for monitoring air passage resistance of an enclosed area by measuring air movements through said connecting tube;

means for generating air pressure pulses arranged inside said enclosed area; and means for evaluating measured air movements through said connecting tube in relation to generation of said air pressure pulses responsive to said means for generating and said means for monitoring.

22. A device according to claim 21 wherein said means for monitoring comprises a bolometer arranged inside said connecting tube.

23. A device according to claim 22 wherein said means for monitoring further comprises:

means for heating said bolometer; and means for evaluating temperature changes of said bolometer.

24. A device according to claim 20 wherein said bolometer is a small heat capacity semiconductor bolometer.

* * * * *